United States Patent [19]

Escaravage

[11] Patent Number: 4,677,715

[45] Date of Patent: Jul. 7, 1987

[54] BUCKLE, ESPECIALLY FOR A SAFETY BELT

[75] Inventor: Gerard Escaravage, Valentigney, France

[73] Assignee: Aciers et Outillage Peugeot, Audincourt, France

[21] Appl. No.: 884,947

[22] Filed: Jul. 14, 1986

[30] Foreign Application Priority Data

Jul. 17, 1985 [FR] France ..... 85-10965

[51] Int. Cl.[4] ..... A44B 11/25

[52] U.S. Cl. ..... 24/637; 24/633; 24/641

[58] Field of Search ..... 24/633, 635, 637, 639, 24/640, 641, 642, 643, 652

[56] References Cited

U.S. PATENT DOCUMENTS

| | | | |
|---|---|---|---|
| 3,345,712 | 10/1967 | Smith et al. | 24/641 |
| 4,382,320 | 5/1983 | Yamamura | 24/633 |
| 4,384,391 | 5/1983 | Lindblad et al. | 24/633 |
| 4,394,792 | 7/1983 | Schmidt | 24/637 |
| 4,451,958 | 6/1984 | Robben et al. | 24/641 |
| 4,527,317 | 7/1985 | Straszewski et al. | 24/641 |
| 4,550,474 | 11/1985 | Doty et al. | 24/640 |
| 4,575,908 | 3/1986 | Gloomis et al. | 24/637 |
| 4,587,696 | 5/1986 | Ueda et al. | 24/637 |

FOREIGN PATENT DOCUMENTS

| | | | |
|---|---|---|---|
| 3404508 | 8/1984 | Fed. Rep. of Germany | 24/633 |
| 1184710 | 3/1970 | United Kingdom | 24/637 |

*Primary Examiner*—Victor N. Sakran

*Attorney, Agent, or Firm*—Sughrue, Mion, Zinn, Macpeak, and Seas

[57] ABSTRACT

This buckle comprises, housed in a casing (1), a body (4), a member for locking (5) a bolt, a sliding block (12) mounted in the said body so as to be capable of travelling in the direction of travel of the bolt and which cooperates with resilient means for ejecting the bolt, means pushing the locking member towards its position in which the bolt is locked, and means for producing (6) unlocking for moving the locking member towards its position in which the bolt is unlocked. This buckle is characterized in that the resilient means for ejecting the bolt and the means pushing the locking member (5) towards its locking position consist of a spring (14) inserted between the sliding block (12) and the locking member (5).

15 Claims, 7 Drawing Figures

BUCKLE, ESPECIALLY FOR A SAFETY BELT

The present invention relates to devices intended to restrain a passenger in his or her seat in an automobile vehicle in the event of a sudden deceleration of the latter, for example during emergency braking or in a collision.

More particularly, the invention relates to a buckle which, in a device of the kind indicated, is intended to attach in a removable manner a length of a safety belt to a fixed point of the vehicle body, for example by means of a tab acting as a lock bolt.

In the state of the art, there are known buckles comprising a casing, in which is placed a stirrup-shaped carrier intended to be fixed to a means of restraint fixed relative to the vehicle body and which, between its arms, defines a guidance passage for the bolt which opens at one end of this stirrup. These buckles also comprise a locking member mounted so that it oscillates in the stirrup around a pivot which is perpendicular to the arms of this stirrup, as well as a stop member mounted so that it slides within these arms and which can be made ineffective by means of a control button, against the action of a resilient return device.

In buckles of this type, the bolt is retained in the buckle by a projecting portion of the locking member which prevents the withdrawal of the bolt from the locking passage, for example by entering an opening provided in the bolt. In the event of a hard pull on the belt which tends to withdraw the bolt from the buckle, this projecting portion cooperates with a stop edge provided in the bottom of the carrier stirrup, if appropriate by elastic deformation of the pivot for oscillation of the locking member in the stirrup, and this enables the buckle to be endowed with a high efficiency and the bolt with a considerable retaining strength.

Also known, from the document FR-2,482,430, is a buckle for a safety belt comprising a carrier intended to be attached to a means for restraint and defining a rectilinear passage into which the bolt may be introduced and which defined a sliding point for the latter. The bolt-locking member is articulated to the carrier around a pivot which lies parallel to the plane of the passage. This locking member may have a first abutment surface retaining the bolt and lying perpendicular to the plane of the passage, while being transverse relative to the latter, in the locked position of the buckle, while the locking member may also have at least one second abutment surface which is intended, in the locked position of the buckle, to come into contact with a stop member mounted so that it moves in translation on the carrier, in a direction at right angles to the axis of articulation of the locking member. The travel of this stop member releases the locking member and hence the bolt during the opening of the buckle, which is controlled by an operating button mounted on the carrier so that it can travel in the same direction as the stop member.

Return springs are provided for acting on the locking member, the stop member and the operating button. The stop member consists of a single-block body which has members for guiding and retaining the springs extending on both sides of this body in opposite directions at right angles to the axis of articulation of the locking member.

The construction of devices of this kind has a number of disadvantages, particularly in respect of the observance of fairly tight tolerances during manufacture, and this increases the production cost of devices of this kind. Furthermore, in modern automobile technology the aim is to reduce the weight and the bulk of equipment as much as possible, in all respects and especially where safety equipment is concerned, without, of course, compromising thereby the efficiency of such equipment.

The purpose of the invention is therefore to provide a safety belt buckle which is simple in construction and easy to fit, by reducing the number of members of which such a buckle is made up.

Another purpose of the invention is to provide a safety belt buckle which is smaller and lighter than the buckles of the prior art and whose manufacture may be undertaken without the need to observe tight tolerances.

To this end, the subject of the invention is a buckle, particularly for a safety belt for an automobile vehicle, which is intended to attach in a removable manner a length of the said belt to a fixed point of the vehicle body, comprising a catch assembly and a bolt forming an integral part of the length to be attached, the catch assembly comprising, housed in a casing, a body intended to be attached to a means of restraint forming an integral part of the vehicle and which defines a passage and a plane of sliding for the said bolt, a member for locking the bolt comprising an operating portion which engages in a cavity in the bolt in the position in which the latter is locked, and articulated to the body so as to be capable of swinging around a pivot which is approximately parallel to the plane of sliding and perpendicular to the direction of travel of the bolt, between a position in which the said bolt is locked and a position in which it is unlocked, a sliding block mounted in the said body so as to be capable of travelling along the direction of travel of the bolt and which cooperates, on the one hand, with a front face of the bolt and, on the other hand, with a spring for ejecting the bolt, means pushing the locking member towards its position in which the bolt is locked and means for producing unlocking for moving the locking member towards its position in which the bolt is unlocked, characterized in that the means for ejecting the bolt and the means pushing the locking member towards its position in which the bolt is locked consist of a spring inserted between the sliding block and the locking member.

The invention will be better understood with the aid of the following description, which is given solely by way of example and given with reference to the attached drawings, in which.

Figure 1:
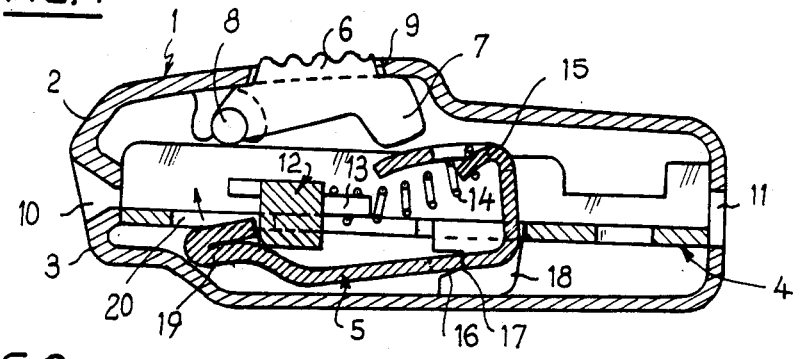
FIGS. 1 to 4 illustrate the operation of a safety belt buckle according to the invention.

As shown in FIG. 1, a safety belt buckle according to the invention comprises a catch assembly arranged in a casing 1 consisting in a manner which is known per se of an upper component 2 and a lower component 3. Inside this casing 1 is arranged a body 4 whose cross-section is generally U-shaped. A locking member 5, which is in the form of a metal blade and which will be described in further detail later, is housed inside this body 4. Furthermore, a member for producing unlocking 6 having a bearing surface 7 is mounted articulated around a pivot 8 forming an integral part of the upper component of the casing 1.

As can be seen, the casing 1 and more particularly the upper component 2 of the latter comprises a light 9 through which projects the member for producing unlocking 6 so that the user of the safety belt buckle has access to this member.

The casing 1 also comprises a first opening 10 whose walls are inclined, opening out into the interior of the casing.

As will be seen later, this opening 10 and the body 4 define a passage and a plane of sliding for, for example, a tab acting as a lock bolt, forming an integral part of a length of the safety belt which is to be attached.

The casing 1 also comprises a second opening 11 provided in the end of the casing 1, opposite the end in which the opening 10 is made. This opening 11 is provided facing an end of the body 4. In the embodiment shown, this opening 11 is intended to permit the passage of a means of restraint (not shown), one end of which is attached to the vehicle and the other end of which is attached to the body 4, so that the body forms an integral part of the vehicle.

According to another embodiment, the said end of the body 4 may project outside the casing 1, through the said opening 11 so as to permit the buckle to be attached, when it is assembled, to various devices for connection to the vehicle body. This enables the buckle to be provided with a wider general applicability.

The buckle also comprises a sliding block 12 mounted so as to be capable of travelling, as will be seen later, by sliding between a forward position and a rear position, in the said body 4, along the direction of travel of the bolt. This sliding block comprises a centring stud 13 for one end of a spring 14, whose other end is centred on a stud 15 formed in one end of the locking member 5, which end is folded back into a U shape. As can be seen, this stud is formed in the upper arm of the U constituting this end of the locking member 5, this arm extending below the bearing surface 7 of the member for producing unlocking 6.

The locking member 5 also comprises two projecting parts forming an articulation pivot 16 and extending on each side of the other arm of the U formed at one of the ends of the locking member, these projecting parts engaging in notches 17, which are, for example, trapezoidal, and are arranged in arms, for example 18, forming a single part with the body 4. These projecting parts form the articulation pivot 16 around which the locking member can oscillate, this articulation pivot being approximately parallel to the plane of sliding of the bolt and perpendicular to its direction of travel.

The locking member 5 also comprises an operating portion 19 extending into a light 20 of the body 4. In this FIG. 1, the safety belt buckle is shown in the open position, that is to say that a first bearing surface of the locking member bears on the sliding block 12. This first bearing surface consists of the said operating portion of the latter, which comes to bear on the sliding block under the action of the spring 14 which tends to move apart the sliding block 12 and the portion of the locking member in which the stud 15 is arranged. This spring pushes the sliding block 12 towards the opening 10 in the casing and causes the locking member 5 to swing on the articulation pivot 16, so that the operating portion of the locking member comes to bear against the sliding block in the unlocked position of the buckle.

It should be noted that, in this position, the locking member 5, the sliding block 12 and the spring 14 form an assembly which is mounted with a certain clearance in the body 4. More particularly, this clearance is defined by the bottom of the notches 17 in the arms 18 of the body 4, in a certain direction, and by a stop edge consisting of a side of the light 20 in the body, arranged facing the operating portion 19 of the locking member, in the other direction.

Figure 2:
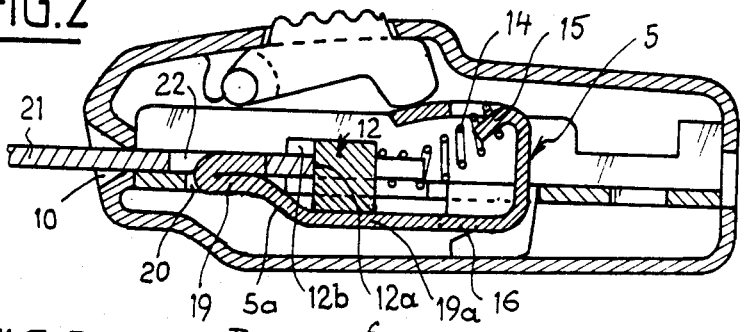

If reference is now made to FIG. 2, it can be seen that when a bolt 21 comprising a cavity 22 is introduced into the buckle via the opening 10, the front face of the former comes to bear against a bearing face **12*a* of the sliding block 12, above which extend the projecting parts 12*b* forming the means for guiding the bolt when it enters or is ejected from the buckle. The sliding block then travels in the body 4, and this results in the spring 14 being compressed. This spring causes the locking member 5 to swing on the articulation pivot 16, to cause the operating portion 19 to enter the cavity 22 in the bolt 21**.

In this locked position, the operating portion 19 of the locking member 5 cooperates with a side of the cavity 22 in the bolt 21 and with a stop edge of the body, consisting of a side of the light 20, to maintain the said bolt in a locked position, when a force is applied to the bolt, tending to make it come out of the buckle.

It should be noted that the operating portion of the locking member 5 consists of a portion, folded back substantially at 180°, to the metal blade forming the locking member, this portion being connected via a shoulder **5*a* to the remainder of this member. A portion 19*a* of the metal blade forming the locking member, and arranged between this first bearing surface and the projecting parts forming the articulation pivot, forms a second bearing surface which, as can be seen in this FIG. 2, bears against the sliding block 12** in the locked position of the buckle so as to limit the swinging motion of the locking member.

Figure 3:
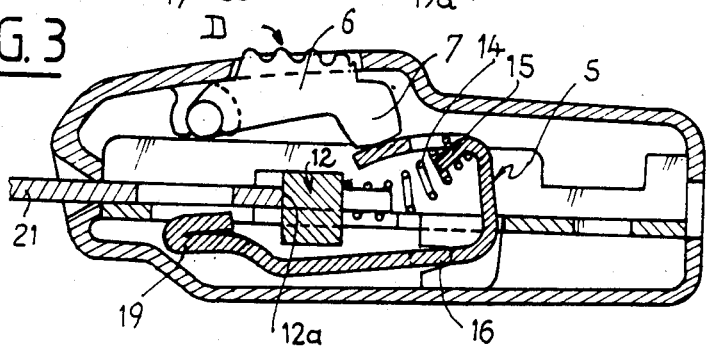

During unlocking (FIG. 3), an action D applied, for example, by the user, to the member for producing unlocking 6 causes the bearing surface 7 of the latter to come into contact with the upper arm of the U formed at this end of the locking member 5. Since, as already seen, this arm extends beyond the centring stud 15 on which one end of the spring 14 is arranged, this action causes the unlocking member 5 to swing on the articulation pivot 16 so that its operating portion is released from the opening 22 in the bolt 21.

Figure 4:
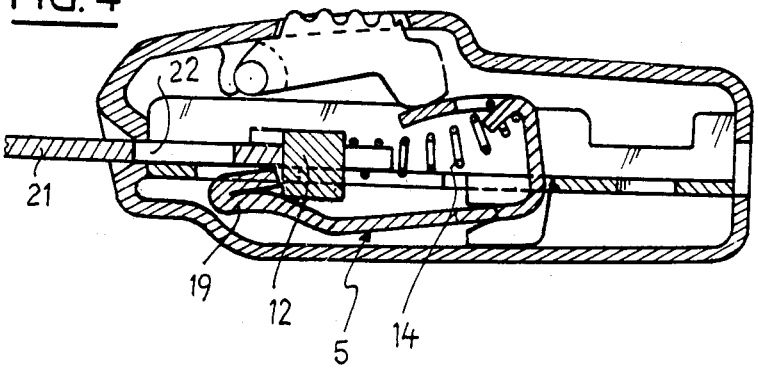

Since the operating portion of the locking member has released this opening 22 in the bolt 21, the sliding block 12 is moved, by the action of the spring 14, to its unlocking position (FIG. 4), ejecting the bolt 21.

Thus, the spring 14 constitutes both the resilient means for ejecting the bolt and the means pushing the locking member towards its locking position.

Figure 5:
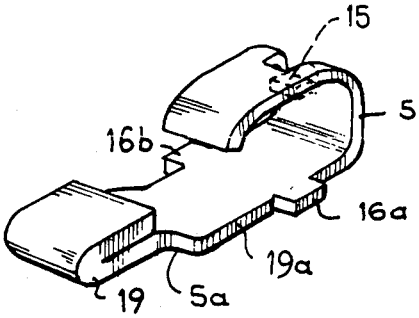
FIG. 5 shows an embodiment of a locking member forming part of the composition of a safety belt buckle according to the invention.

As shown in FIG. 5, the locking member 5, which may be advantageously made of steel, comprises an operating portion 19 consisting of a portion folded back substantially at 180° to the material forming this member, this portion being connected to the remainder of the member by the shoulder **5*a*. The portion 19*a* of the metal blade, situated between the operating portion and the projecting parts, defines, as already seen, the second bearing surface of the locking member. The first and second bearing surfaces are thus determined by this shoulder 5***a*. At its other end, this locking member has a portion folded back into a U shape whose upper arm determines, as already seen, the bearing surface cooperating with the member for producing unlocking 6. Also formed in this upper arm is the centring stud 15 intended to receive the end of the spring 14 for ejecting the bolt and pushing this locking member towards its locking position. This locking member also comprises two projecting parts 16*a* and 16*b* extending on each side of the lower arm of the U and engaging into the notches in the arms of the body 4 of the safety belt buckle, so as to permit a swing of the locking member between the position in which the bolt is unlocked and the locking position inside the buckle.

Figure 6:
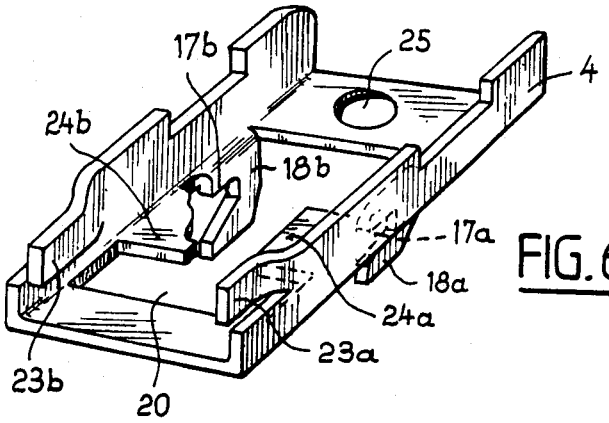
FIG. 6 shows an embodiment of a body forming part of the composition of a safety belt buckle according to the invention.

As shown in FIG. 6, a body 4 which is generally U-shaped in cross-section comprises a passage for the end of the bolt, this passage being determined by the sides 23*a* and 23*b* formed in the two arms of the U forming the said body.

In its middle part this body 4 comprises the light 20 which has two guidance sides 24*a* and 24*b*, which are intended to cooperate with the sliding block to make it easier for the latter to slide in the body.

The body 4 also comprises two arms 18aand 18*b* formed on each side of the said light 20 and in which are provided trapezoidal notches 17*a* and 17*b* intended to receive the projecting parts 16*a* and 16*b* of the locking member. As already seen, a cavity 25 enables this body 4 to be attached to a means of restraint forming an integral part of the vehicle in order to attach the safety belt buckle to the vehicle.

Figure 7:
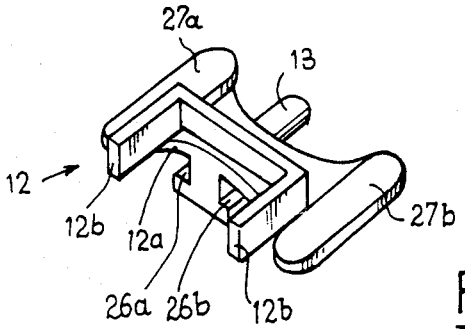
FIG. 7 shows an embodiment of a sliding block forming part of the composition of a safety belt buckle according to the invention.

As shown in FIG. 7, the sliding block 12 comprises a centring stud 13 intended to receive one end of the spring 14. This sliding block also comprises two guidance grooves 26*a* and 26*b* cooperating with the guidance sides 24*a* and 24*b* of the body so as to enable it to slide in the said body. The guidance of the sliding block is also made easier by the presence of side guidance skids 27*a* and 27*b*, arranged on each side of the sliding block and coming to bear on the sides 24*a* and 24*b* of the light 20. The sliding block 12 also comprises the bearing face 12*a* intended to cooperate with the front face of the bolt when it enters or is ejected from the buckle. Projecting parts 12*b* extend above this bearing face of the sliding block to guide the end of the bolt when it enters or is ejected from the buckle.

I claim:

1. Buckle, particularly for a safety belt for an automobile vehicle, which is intended to attach in a removable manner a length of the belt to a fixed point of the vehicle body, comprising a catch assembly and a bolt (21) forming an integral part of the length to be attached, the catch assembly comprising, housed in a casing (1), a body (4) intended to be attached to a means of restraint forming an integral part of the vehicle and which defines a passage and a plane of sliding for the bolt, a member for locking (5) the bolt comprising an operating portion (19) which engages in a cavity (22) in the bolt (21) in the position in which the latter is locked, and articulated to the body (4) so as to be capable of swinging around an articulated pivot (16) which is approximately parallel to the plane of sliding and perpendicular to the direction of travel of the bolt, between a position in which the bolt is locked and a position in which it is unlocked, a sliding block (12) mounted in said body (4) so as to be capable of traveling along the direction of travel of the bolt (21) and which cooperates, on the one hand, with a front face of the bolt and, on the other hand, with resilient means for ejecting the bolt, means pushing the locking member towards its position in which the bolt is locked and means for producing unlocking (6) for moving the locking member (5) towards its position in which the bolt is unlocked, wherein the resilient means for ejecting the bolt and the means pushing the locking member towards its position in which the bolt is locked, consist of a spring (14) inserted between the sliding block (12) and the locking member (5); wherein said sliding block (12) is mounted so as to be capable of traveling in the body (4) between a forward position, in which a first bearing surface of the locking member is bearing against the sliding block (12), corresponding to the position in which the bolt is unlocked, and a rear position in which the locking member has oscillated relative to said body, so that a second bearing surface of the locking member is bearing against the sliding block, corresponding to the position in which the bolt is locked.

2. Buckle as claimed in claim 1, wherein, in the locking position, the operating portion (19) of the locking member (5) cooperates with a side of the cavity (22) in the bolt (21) and with a stop edge of the body to retain the bolt in a locked position in the buckle.

3. Buckle as claimed in claim 2, wherein the said stop edge of the body consists of a side of a light (20) arranged in the body (4).

4. Buckle as claimed in claim 1, wherein the locking member consists of a metal blade having the said operating portion (19) at one of its ends and a portion folded back into a U shape at its other end.

5. Buckle as claimed in claim 4, wherein the articulation pivot consists of two projecting parts (16*a*, 16*b*) extending on each side of one of the arms of the U formed at one of the ends of the locking member (5), these projecting parts engaging in notches (17*a*, 17*b*) arranged in arms (18*a*, 18*b*) extending substantially at right angles below the said body (4).

6. Buckle as claimed in claim 5, wherein the said arms (18*a*, 18*b*) form a single part with the body (4).

7. Buckle as claimed in claim 5 or 6, wherein the other arm of the U determines a bearing surface intended to cooperate with the member for producing unlocking (6) for moving the locking member (5) towards its unlocking position.

8. Buckle as claimed in claim 7, wherein this other arm also comprises a stud (15) for receiving one end of the said spring (14).

9. Buckle as claimed in claim 4, wherein the said first bearing surface consists of the said operating portion (19) of the locking member (5) and wherein the said second bearing surface consists of a portion (19*a*) of the metal blade forming the locking member, arranged between the said operating portion of the latter and the projecting parts forming the articulation pivot.

10. Buckle as claimed in claim 9, wherein the operating portion of the locking member consists of a portion folded back substantially at 180° to the metal blade.

11. Buckle as claimed in claim 10, wherein the first and second bearing surfaces are determined by a shoulder (5*a*) connecting the said operating portion (19) of the locking member (5) to the remainder thereof.

12. Buckle as claimed in claim 1, wherein the sliding block (12) comprises grooves (26*a*, 26*b*) and skids (27*a*, 27*b*) for guidance, which are intended to cooperate with guidance surfaces of the body (4).

13. Buckle as claimed in claim 12, wherein the said guidance surfaces consist of sides (24*a*, 24*b*) of the light (20) arranged in the said body.

14. Buckle as claimed in claim 1, wherein the said sliding block (12) comprises means for guiding the bolt when it enters or is ejected from the buckle.

15. Buckle as claimed in claim 14, wherein the guiding means consist of projecting parts (12*b*) extending above one bearing face (12*a*) of the sliding block, which is intended to cooperate with the front face of the bolt when it enters or is ejected from the buckle.

* * * * *